US007832772B2

(12) United States Patent
Leseman et al.

(10) Patent No.: US 7,832,772 B2
(45) Date of Patent: Nov. 16, 2010

(54) EXHAUST PIPE BULKHEAD ASSEMBLY

(75) Inventors: Gary T. Leseman, Houston, TX (US); Joseph B. Davis, Richmond, TX (US)

(73) Assignee: Leseman Davis, LLC, Houston, TX (US)

( * ) Notice: Subject to any disclaimer, the term of this patent is extended or adjusted under 35 U.S.C. 154(b) by 239 days.

(21) Appl. No.: 12/212,633

(22) Filed: Sep. 17, 2008

(65) Prior Publication Data

US 2009/0113884 A1 May 7, 2009

Related U.S. Application Data

(60) Provisional application No. 60/993,973, filed on Sep. 17, 2007.

(51) Int. Cl.
*F16L 11/12* (2006.01)

(52) U.S. Cl. ..... 285/47; 285/141.1; 285/215

(58) Field of Classification Search ..... 285/100, 285/109, 47, 141.1, 139.2, 139.3, 215, 56, 285/216, 217
See application file for complete search history.

(56) References Cited

U.S. PATENT DOCUMENTS

| | | | | | |
|---|---|---|---|---|---|
| 3,848,897 | A * | 11/1974 | McClellan | ..... | 285/47 |
| 4,332,393 | A * | 6/1982 | Cuschera | ..... | 285/196 |
| 5,378,026 | A * | 1/1995 | Ninacs et al. | ..... | 285/47 |
| 5,746,453 | A * | 5/1998 | Roberts | ..... | 285/47 |
| 7,708,286 | B2 * | 5/2010 | Henry | ..... | 285/139.3 |

* cited by examiner

*Primary Examiner*—David E Bochna
(74) *Attorney, Agent, or Firm*—Locke Lord Bissell & Liddell, LLP

(57) ABSTRACT

An assembly for establishing a water-tight seal for a conduit passing through a wall or other structure wherein the conduit conveys heated fluid, such as exhaust gasses. The assembly is adapted to minimize the heat transferred to the wall or other structure by creating a circuitous heat transfer path in conjunction with thermally insulating materials.

5 Claims, 4 Drawing Sheets

EXHAUST PIPE BULKHEAD ASSEMBLY

CROSS REFERENCE TO RELATED APPLICATIONS

This application claims the benefit of and priority to U.S. Provisional Application Ser. No. 60/993,973 filed on Sep. 17, 2007, and the entire contents of that application are incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to water-tight and heat-dissipating assemblies; and more specifically related to a bulkhead assembly for an engine exhaust pipe.

2. Description of the Related Art

Structural vessels of many different types often times employ stationary energy sources, such as diesel engines. Exhausting the combustion gasses from these energy sources typically requires routing exhaust pipes or conduits through bulkheads, walls, floors, ceilings and other structural elements of the vessels.

The temperature of these exhaust gasses may range between about 500° F. and 1100° F., and some of this heat will be transferred to the exhaust system. To the extent the exhaust system is thermally connected to components of the vessel, those components will likewise be heated by the exhaust gasses.

It is oftentimes undesirable or prohibited to transfer heat from the exhaust system to vessel components. For example, and without limitation, diesel fuel storage tanks may be constructed such that one or more walls of the tank is also a structural component of the vessel. In such situation, it is not desirable, and may be prohibited in certain regions, to transfer exhaust heat to the vessel structure that forms a portion of the fuel tank.

The inventions disclosed and taught herein are directed to an assembly that allows an exhaust system, such as an exhaust conduit, to pass through a structural portion of a vessel, such as a bulkhead, in water-tight fashion and with minimal transfer of heat to the bulkhead.

BRIEF SUMMARY OF THE INVENTION

In general terms, one embodiment of the invention may be described as an assembly, comprising a first structural element having a flange adapted to be rigidly connected to an exhaust conduit, and a wall portion extending from the flange; a second structural element having a flange adapted to be rigidly connected to a bulkhead, and a wall portion extending from the flange; a first annular region defined between the wall portions of the first and second elements; a second annular region defined between the first annular region and the exhaust conduit; a floating ring of predetermined radial width disposed within the first annular region; a first thermal gasket in the first annular region and interposed between the first element and the floating ring; a second thermal gasket in the first annular region and interposed between the second element and the floating ring; thermal insulation in the second annular region and interposed between the exhaust conduit and the first annular region; a first plurality of connectors connecting the first element to the floating ring; a second plurality of connectors connecting the second element to the floating ring; whereby the exhaust conduit is sealed to the bulkhead in fluid tight fashion while minimizing the heat transferred from the exhaust conduit to the bulkhead.

DETAILED DESCRIPTION

Figure 1:
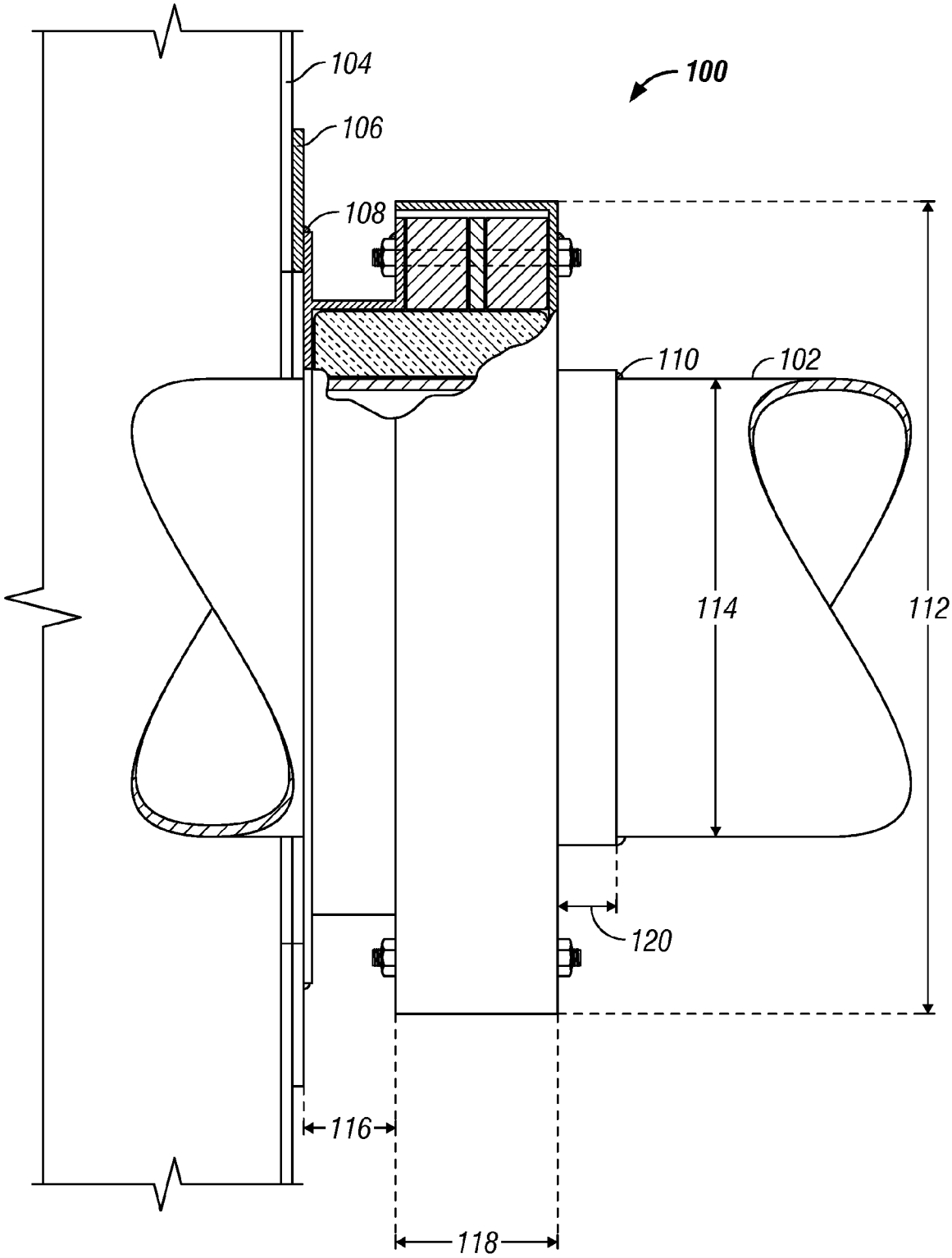
FIG. 1 illustrates an overhead or side view of one of many possible embodiments of the present invention.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

In general terms, we have invented an assembly of components that allows a pipe or conduit conveying heated fluid, such as, but not limited to internal combustion exhaust gasses, to pass through a wall, floor, ceiling, bulkhead or other portion of a vessel or building in water-tight fashion, and with limited transfer of heat from the fluid or pipe.

Generally, embodiments of the invention may comprises a first portion adapted to interface with the exhaust pipe or conduit and a second portion adapted to interface with the wall or such of the vessel or building. The first and second portions are held in water-tight arrangement by a plurality of first connectors that connect the first portion to a floating ring, and a second set of connectors that connect the second portion to the floating ring. Sandwiched between the first and second portions and the floating ring are gaskets adapted to seal against fluid intrusion and to withstand the high temperatures associated with the exhaust pipe. The floating ring is spaced from the outside of the exhaust pipe by a layer of thermal insulation. In this type of embodiment of the present invention, conduction of heat from the exhaust pipe to the vessel or building is limited to a circuitous path through the first and second connectors and floating ring. This type of conduction path substantially reduces the heat transferred to the vessel or building.

Turning now to a more detailed description of one of many possible embodiments of the present invention, FIG. 1 is an illustration of an assembly particularly useful for offshore drilling rigs, offshore production platforms, ships and/or boats in which internal combustion engine exhaust gasses are piped through the exterior wall or bulkhead of the vessel. This embodiment provides a water-tight seal preventing or lessening the intrusion of seawater and other water into the vessel, and lessening the transfer of heat from the exhaust gasses to the vessel.

FIG. 1 shows an assembly 100 fitted about an exhaust pipe 102. The assembly 100 can be used adjacent the terminal portion of the exhaust pipe 102 or along any portion of the length of the exhaust pipe 102. The assembly 100 is illustrated to be attached to the exterior of the exhaust pipe 102 by, for example, a circumferential weld 110. The assembly 100 is also shown to be attached to the vessel, wall or bulkhead 104, or doubler plate or reinforcing pad 106 by, for example, a circumferential weld 108. This particular embodiment measures approximately 30 inches in outer diameter 112 for a exhaust pipe 102 of about 22 inches in diameter 114. The assembly 100 measure about 9 inches in length overall comprising a standoff 116 of about 3 inches, a main section 118 of about 4 inches and an exhaust section 120 of about 2 inches.

Figure 2:
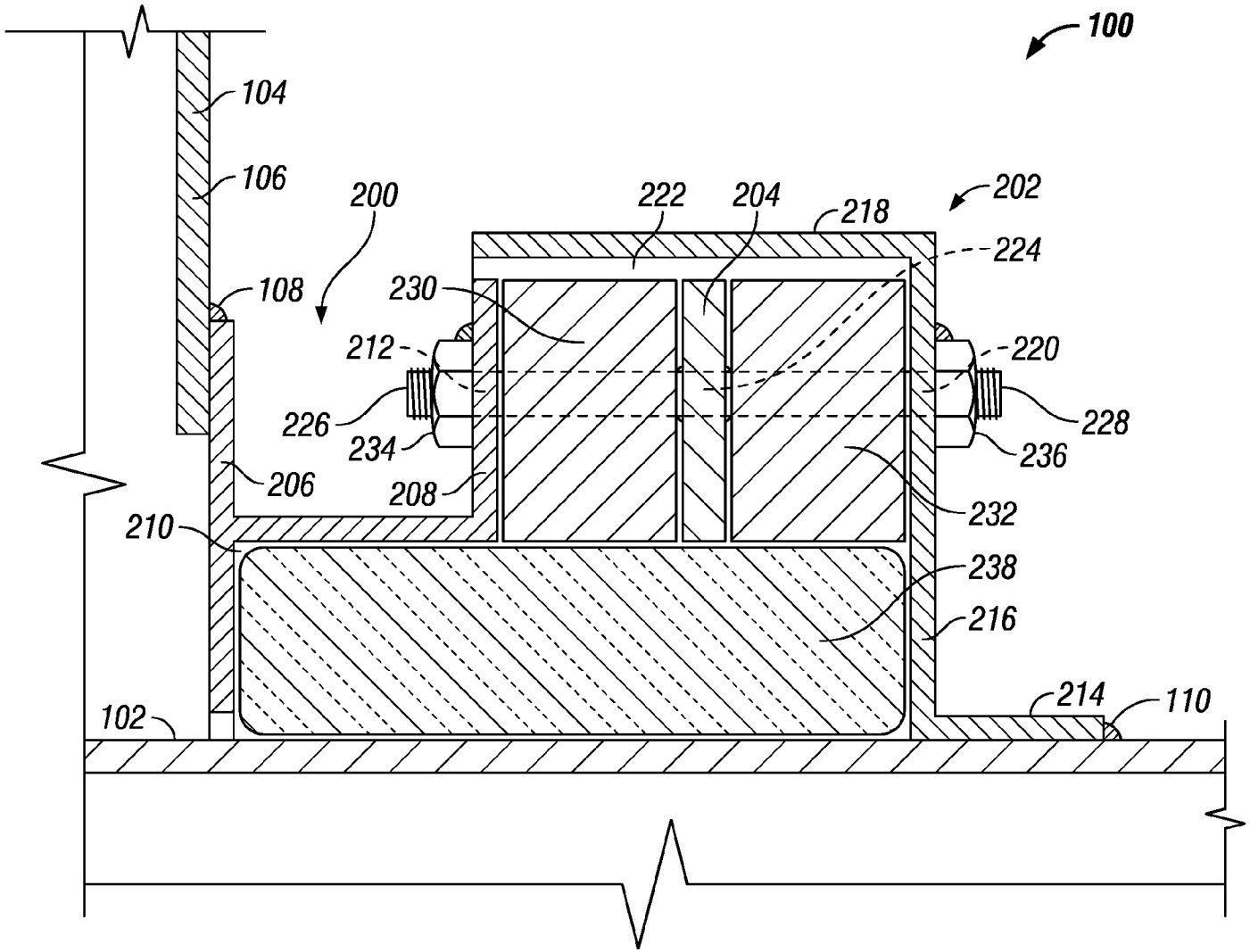
FIG. 2 illustrates a cross-sectional view of a portion of the embodiment shown in FIG. 1.

FIG. 2 shows a more detailed cross-section of the assembly 100 illustrated in FIG. 1. The assembly 100 comprises a vessel or bulkhead portion 200, an exhaust portion 202, and a floating ring 204. Bulkhead portion 200 comprises a structural shape having a flange 206 adapted to mount to or connect with the bulkhead 104,106. The flange 206 is connected, integrally or otherwise, to a wall portion 208. Bulkhead portion 200 is spaced apart from the exhaust pipe 102 a fixed distance to create a portion of an annular region 210. As will be discussed in more detail below, the wall portion 208 has a plurality of holes formed axially (with respect to the exhaust pipe 102) therein.

The exhaust portion 202 comprises a flange portion 214 connected, integrally or otherwise, to a wall portion 216. It is preferred that exhaust portion 202 also comprise a cover portion 218. Similarly to the wall portion 208 of the bulkhead assembly 200, the wall portion 216 of the exhaust assembly 202 has a plurality of holes 220 formed axially therein, but radially offset from (i.e., not axially aligned with) the holes 212 in the bulkhead assembly 200. The flange 214 is connected to the exhaust pipe 102, such as by weld 110, at a predetermined distance along the exhaust pipe 102 from the bulkhead 104, 106, thereby forming a second annular region 222 radially displaced from the first annular region 210.

The floating ring 204 is disposed within the second annular region 222 and is substantially centered therein. The floating ring 204 has a plurality of holes 224 formed therein and in radial and axial alignment with the holes 212 and 220. It is preferred that that the floating ring holes 224 be threaded to accept threaded fasteners 226 and 228. Interposed between the walls 208, 216 and the floating ring 204 are thermal gaskets 232. While those of skill in the art will appreciate that various types of gaskets or materials may be used, it is preferred that gaskets like those available from Flexatallic Limited, such as the Flexatallic SF 3300 be used. Such gaskets provide fluid sealing as well as thermal isolation.

As can be seen from FIG. 2, one set of connectors 226 extend from the ring 204, through the gasket 230 and through the holes 212 in the bulkhead assembly wall 208. The gasket 230 is compressed between the ring 204 and the wall 208 by nuts 234. Similarly, the second set of connectors 228 extend from the ring 204, through the gasket 232, and through the holes 220. The gasket 232 is compressed between the ring 204 and the wall 216 by nut 236. Once the assembly 100 is compressed to the appropriate level to achieve water-tightness, the nuts 234 and 236 may be tack welded or otherwise locked into position. It will also be appreciated that connectors 226 and 228 may be tack welded or otherwise locked to the floating ring 204 as desired or required.

Also shown in FIG. 2 is insulation 238. Insulation 238 prevents or at least lessens convective or radiative heat transmission from the exhaust pipe 102 to the assembly 100. While those of skill in the art will appreciate that various types of insulation or thermal material may be used, we have found that Micro-Flex® pipe and tank wrap marketed by Johns Manville is suitable for this purpose.

FIG. 2 also shows engineered heat expansion gaps 240 and 242. It will be appreciated that because the gaskets are compressed to form a water or fluid-tight seal, these expansion gaps do not affect the water-tight performance of assembly 100.

Figure 3:
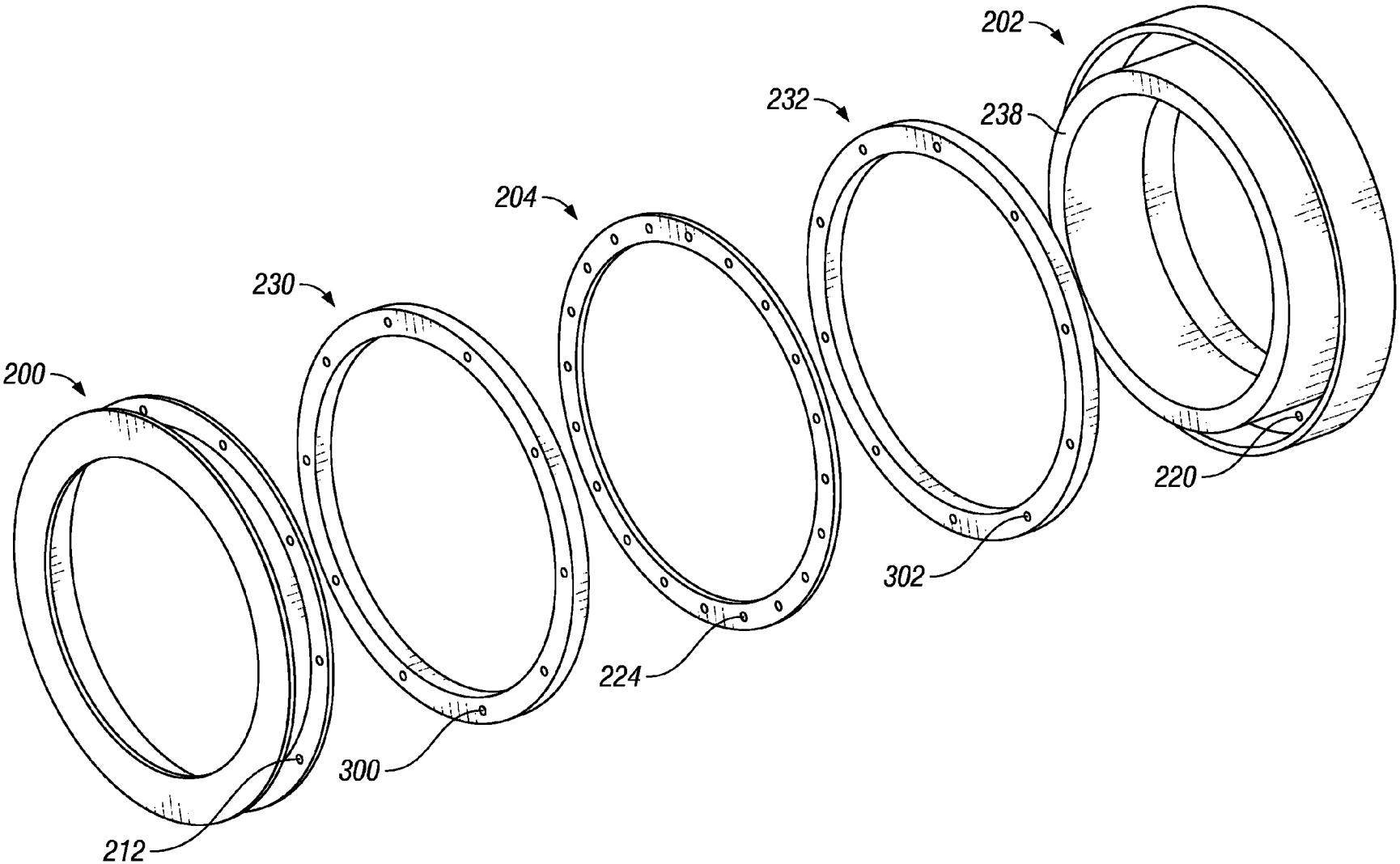
FIG. 3 is an exploded view of the embodiment shown in FIG. 1.

FIG. 3 shows an exploded view of the assembly 100 and shows the bulkhead portion 200 with holes 212, and gasket 230 with holes 300 substantially aligned with the holes 212 in the bulkhead portion 200. Exhaust portion 202 is shown with holes 220, and gasket 232 with holes 302 substantially aligned with the holes 220 in the exhaust portion 202. Floating ring 204 is shown in exploded position and having holes 224. As described above, floating ring 204 has one set of holes 224 for connectors 226 and another set of holes 224 for connectors 228.

In one particular embodiment of the present invention substantially similar to the embodiment described in FIGS. 1, 2 and 3, engine exhaust gasses at a temperature of about 750° F. passed through a vessel bulkhead and the assembly described herein maintained the bulkhead immediately adjacent the assembly 100 at a temperature of about 10° F. above ambient temperature.

Figure 4:
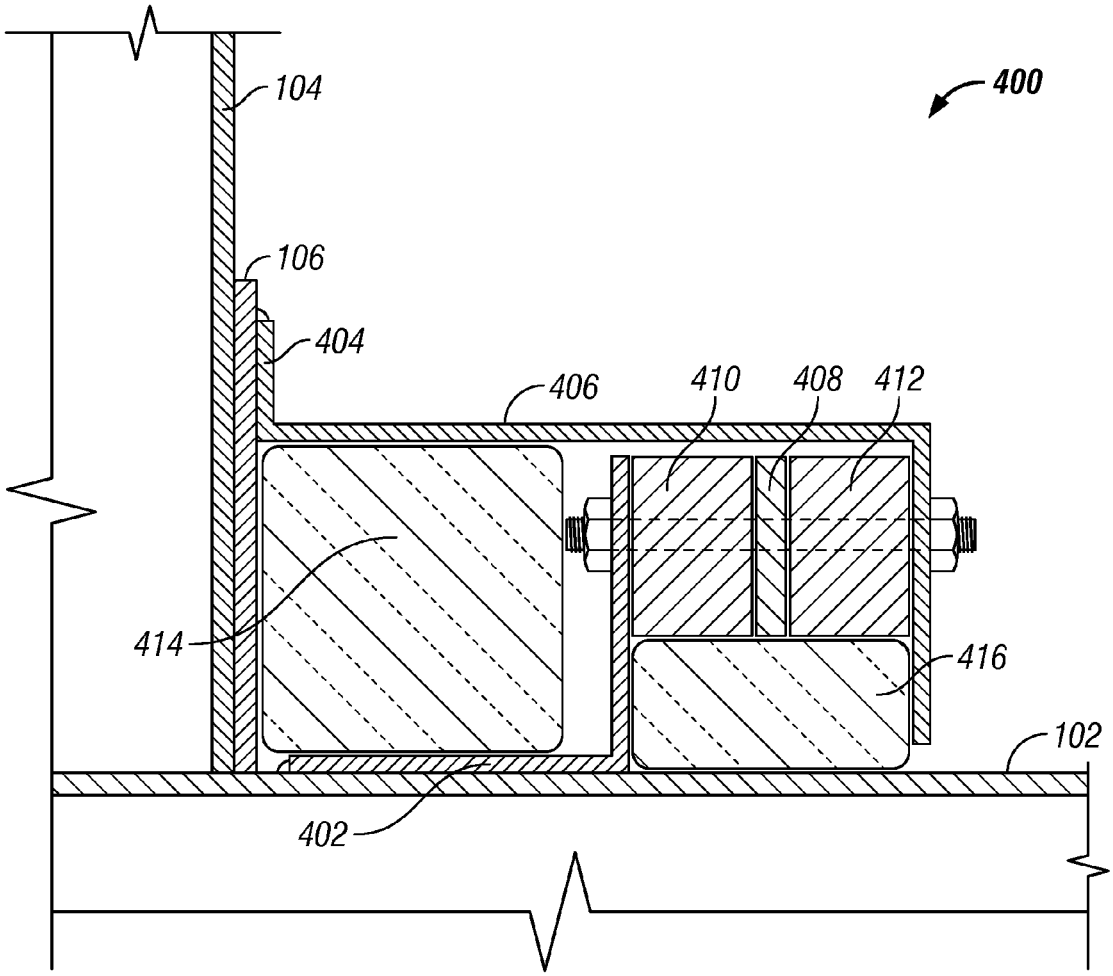
FIG. 4 illustrates one of many alternate embodiments of the present invention.

Other and further embodiments utilizing one or more aspects of the inventions described above can be devised without departing from the spirit of our invention. For example, threaded fasteners and nuts can be replaced with bolts, more that one floating ring can be used to further increase the length of the heat path. Further, the embodiment described herein and the methods of using the embodiment can be included in combination with each other to produce variations of the disclosed methods and embodiments. For example, and without limitation, FIG. 4 discloses an alternate embodiment 400 in which the exhaust portion 402 is disposed adjacent the bulkhead 104, 106 and the bulkhead portion 404 includes a roof or shield portion 406. This embodiment comprises structures similar to the embodiment of FIGS. 1-3, including a floating ring 408, gaskets 410 and 412, and insulation 414 and 416. Structural elements that have been described functionally and can be embodied as separate components or can be combined into components having multiple functions.

Thus, our invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by us, but rather, in conformity with the patent laws, we intend to fully protect all such modifications and improvements that come within the scope or range of equivalent of the following claims.

What is claimed is:

1. An assembly, comprising:

a first structural element having a flange adapted to be rigidly connected to an exhaust conduit, and a wall portion extending from the flange;

a second structural element having a flange adapted to be rigidly connected to a bulkhead, and a wall portion extending from the flange;

a first annular region defined between the wall portions of the first and second elements;

a second annular region defined between the first annular region and the exhaust conduit;

a floating ring of predetermined radial width disposed within the first annular region;

a first thermal gasket in the first annular region and interposed between the first element and the floating ring;

a second thermal gasket in the first annular region and interposed between the second element and the floating ring;

thermal insulation in the second annular region and interposed between the exhaust conduit and the first annular region;

a first plurality of connectors connecting the first element to the floating ring;

a second plurality of connectors connecting the second element to the floating ring; and whereby the exhaust conduit is sealed to the bulkhead in fluid tight fashion while minimizing the heat transferred from the exhaust conduit to the bulkhead.

2. The assembly of claim 1, wherein the exhaust conduit and the first and second elements and the floating ring are substantially round.

3. The assembly of claim 2, wherein the first and second plurality of connectors comprise threaded fasteners each of which threadingly engages a threaded orifice in the floating ring, and nuts that react against the associated wall portion of the first and second elements.

4. The assembly of claim 3, wherein each nut is welded to the wall.

5. The assembly of claim 4, wherein the first element flange is welded to the exhaust conduit, and wherein the second element flange is welded to the bulkhead.

* * * * *